United States Patent [19]

De Biasi

[11] 4,142,346

[45] Mar. 6, 1979

[54] APPARATUS AND METHOD FOR APPLYING CLOSURES TO BAGS AND THE LIKE

[75] Inventor: Joseph T. De Biasi, Mississauga, Canada

[73] Assignee: Professional Packaging Limited, Mississauga, Canada

[21] Appl. No.: 613,999

[22] Filed: Sep. 17, 1975

[51] Int. Cl.[2] ..... B65B 51/04

[52] U.S. Cl. ..... 53/416; 53/482; 53/487; 229/65

[58] Field of Search ..... 53/14, 46, 44, 45, 370, 53/15, 371, 41, 138 R, 138 A; 229/62, 65, 66

[56] References Cited

U.S. PATENT DOCUMENTS

| | | | |
|---|---|---|---|
| 633,007 | 9/1899 | Humphrey | 53/14 X |
| 1,026,234 | 5/1912 | Abrahams | 53/138 R X |
| 1,766,405 | 6/1930 | Shaw | 53/46 X |
| 2,093,978 | 9/1937 | Farmer | 229/65 X |
| 2,134,567 | 10/1938 | Long et al. | 53/371 |
| 2,356,110 | 8/1944 | Waters | 229/65 X |
| 3,458,110 | 7/1969 | Goldman | 229/65 X |

*Primary Examiner*—Horace M. Culver

*Attorney, Agent, or Firm*—Sim & McBurney

[57] ABSTRACT

Bags having side panels and front and back panels — such as laminated paper bags in which produce such as biscuits and cookies are sold — may have closures attached to them so that the bag is closed and sealed with product inside for wholesale and retail sales, and may be opened and re-closed by the end purchaser. Where the closures comprise a pre-formed plastic closure having at least one open jaw into which the top of the bag, when shut, is inserted, and which are applied to a portion of the front panel of the bag. Apparatus is provided for applying the closure to the bag, which apparatus comprises means for applying the closure to the folded top of the bag which is intended to be inserted in the closure when in use, means for applying adhesive to the closure, and means for maintaining the closure and surface of the bag in contact one with the other while the adhesive between them becomes effective. The apparatus may include sufficient work stations to fold the panels of the bag with produce in it; and also plastic forming, cooling and cutting work stations for forming the individual closures from a strip or roll of suitable sheet plastic.

4 Claims, 9 Drawing Figures

FORMING
COOLING
CUT & APPLY
WIPE GLUE
FOLD DOWN
PRESSURE (& COOLING)

APPARATUS AND METHOD FOR APPLYING CLOSURES TO BAGS AND THE LIKE

FIELD OF THE INVENTION

This invention relates to apparatus for applying closures to bags and the like, and a method for applying such closures to bags; and more particularly, this invention relates to an apparatus for applying closures to bags such as those in which biscuits and cookies, and the like, are packaged by the manufacturer of such products and sold by the manufacturer for ultimate sale and use by the consuming public. This invention provides apparatus for applying closures to bags where the closures are adhesively affixed to an exterior surface of the bag in such a manner that the bag may be opened and re-closed at will by the consumer.

BACKGROUND OF THE INVENTION

For many years, manufacturers and producers of such products as biscuits and cookies have had only several choices in the nature of package in which their product might be priced for retail sale. Such choices have included biscuit boxes — usually of sheet steel and the like — which, because of their cost, are only used for premium quality products which are sold at very high prices; as well as the more ordinary cardboard boxes and bags. In the latter category, the bags are usually laminated paper bags, where the interior laminates are of a plastic or paper material which is generally impervious to moisture, and the outer laminates are such that they may be printed upon for purposes of designating the product being sold in that package, its ingredients, etc.

Needless to say, any such package as is used by the manufacturer or producer of products such as biscuits and the like must be such that the product can be placed in the package by the manufacturer at his plant, in such a manner that the products are thereby sealed in a sanitary fashion sufficient to meet the requirements of Health Authorities and other Government and regulatory bodies; as well as to meet the rigours of crating, shipping, being placed on retail shelves, etc. Also, of course, the manufacturer is anxious to keep his packaging costs as low as possible in order that the highest reasonable portion of the consumers' money goes towards purchase of the product, and not of the package.

When consideration is made of the usual kind of bag in which biscuits, cookies and the like are sold to the retail market — other than single laminate plastic bags — it will be noted that such bags are sealed by a sealing strip which is placed across the top edge of the front or back panel of the bag in such a manner that when the top edges of the front and back panels of the bag are brought together and several folds made in them for purposes of sealing the bag, the strip extends laterally beyond the sides of the bag in such a manner that it may be then folded downwardly at each side of the bag so as to engage a crease formed between the front or back panel and the side panel of the bag at each side. In the usual circumstances, a thin ribbon or wire of metal — usually steel — is embedded in the sealing strip which is attached at the top edge of the front or rear panel of the bag, in order to provide the ability for the strip to be bent or folded into engagement with the front/side or back/side crease.

As the cost of steel increases, the cost of the sealing strip for such bags has also increased, thereby driving up the packaging costs for products to be sold in such bags. Also, it has been necessary to provide very complicated apparatus for creating the fold at each end of the sealing strip and to assure that the sealing strip engaged the appropriate crease in order to ensure that the package itself was properly sealed; or, in some operations, to employ hand labour.

Recently, a bag closure for such bags at those discussed above, where at least the front, back and side panels of the bag are pliable, has been developed. That closure is applied to one of the front or back panels of the bag — for purposes of further discussion, it will be assumed that it is the front panel of the bag to which the closure is applied — and has at least one tab portion formed therein which presents a hook-like pre-formed open jaw into which the folded top of the bag, when shut, may be inserted. In its usual embodiment, the closure just described has two pre-formed jaws, and is formed from sheet plastics material such as ABS or styrene.

One difficulty which has arisen, however, with the newly developed closure referred to above is that apparatus for applying that closure to a bag having product in it, without causing localized heating or crushing pressure against the product within the bag, has not previously been available. It was perceived, however, that if the bag having product in it were to be closed and folded in substantially the normal manner as employed in apparatus presently installed in most manufacturing facilities for production of packaged biscuits and the like, it would then be possible to apply a closure such as that discussed above over the folded end of the bag which would be intended to be inserted in the closure when the bag is being used by the consumer, and thereafter to apply a suitable adhesive to the closure and to fold over the folded top end of the bag so that the closure is applied to the front surface of the bag — usually at the shoulder formed therein during the folding operation so as to be above the product within the bag, and maintained in such a position while the adhesive bond between the closure and front panel of the bag at least partially sets up. The bag would then be sealed and closed, and ready for packaging, shipment and retail sale in the usual manner.

Thus, this invention provides an apparatus for applying closures to bags and like containers, where the closure is as discussed above, consisting of conveyor means for feeding a plurality of bags or the like, seriatim, past a plurality of work stations in the apparatus; where at least one of the work stations is adapted for shutting the mouth of each bag in turn as it is presented at that station, so that the top end of each bag when the mouth is shut is upwardly facing, with the front and back panels of the bag being substantially contiguous at the top end. Means are provided for placing a closure over the upwardly facing top end, and the closure is oriented in such a manner that at least a portion of the main panel portion of the closure which is intended to contact the front panel of the bag is presented to means which applies an adhesive to that portion. Means are also provided in the apparatus for folding down the top end of the bag so that the portion of the closure to which the adhesive has been applied is brought into contact with the panel of the bag to which it is intended that the closure shall be applied; and further means are provided for maintaining contact between the closure and the front panel of the bag until such time as the adhesive bond between them is at least partially set up.

In the usual embodiment of apparatus according to the present invention, additional means are provided for forming the closure from suitable sheet plastics material.

Additionally, the present invention provides a method of applying closures of the sort discussed above to such packages as bags, by feeding a plurality of such bags, seriatim, past at least one station where the top ends of the front, back and side panels of the bag are folded; and thereafter applying the closure to the folded top end of the bag, applying adhesive to an appropriate surface of the closure, and folding the top end of the bag and closure forward so that the adhesive-coated portion of the closure is brought into contact with a portion of the front panel of the bag, and then temporarily applying pressure against the closure.

In all of the above, according to the present invention, the closure is applied to the bag after the bag has been closed and sealed by making several folds in the top ends of the front, back and side panels of the bag. This is important because the manufacturer of the product being packaged is not, therefore, reliant upon a particular supplier of bags having special closures already included — i.e., pre-assembled — in them; and also so that the manufacturer can use different sizes, qualities and weights of bags in the same apparatus, without having to be concerned about the width of each bag for purposes of folding a sealing strip at each side thereof. Simple adjustments may be made to apparatus according to this invention to accommodate the height of the bag being closed, and the size of the bag being closed by adjusting the machine timing.

BRIEF SUMMARY OF THE INVENTION

A purpose of the present invention is to provide an apparatus for applying closures to bags and like containers in which biscuits, cookies and the like are packaged by the manufacturer of such products, and where the apparatus can accommodate various sizes of such bags.

A feature of the present invention is that the apparatus provided hereby may incorporate a plurality of work stations for shutting, closing and sealing the bag, as well as work stations for forming and cutting the closure just prior to applying a closure to a bag.

Another object of this invention is to provide apparatus for applying closures to bags, where the apparatus can be installed with a minimum of disruption, and with a maximum of economy and efficiency, in an operating packaging line.

Yet another object of this invention is to provide a method for applying closures to bags, wherein the product to be packaged within the bag is already placed and sealed within the bag before the closure is applied to the bag.

BRIEF DESCRIPTION OF THE DRAWINGS

These and other features and objections of the invention will become more obvious hereafter, in the following detailed discussion taken in association with the accompanying drawings, in which.

DESCRIPTION OF THE PREFERRED EMBODIMENT

Figures 1, 2, 3, 4:
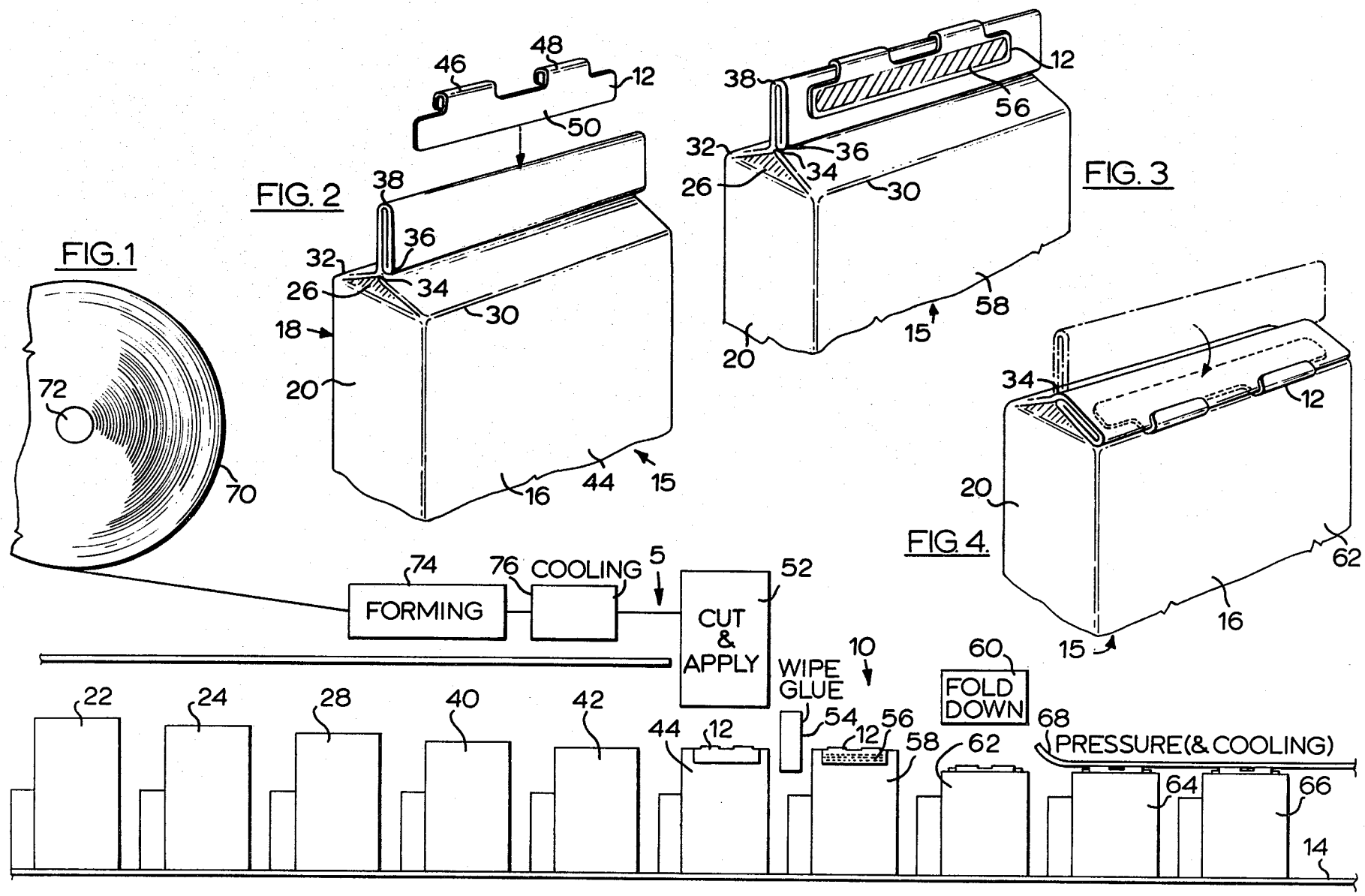
FIG. 1 is a substantially schematic side view of an apparatus according to the present invention.
FIG. 2 is an exploded perspective view of a manufacturing step accomplished by apparatus according to this invention and in accordance with the method of the present invention.
FIG. 3 is a perspective view similar to FIG. 2, showing a further step.
FIG. 4 is yet a further perspective view similar to FIGS. 2 and 3.

As noted above, the present invention relates particularly to a method and apparatus for applying closures to bags and like containers where the closure is such that it has a hook-like pre-formed open jaw into which the top of the bag, when shut, is inserted. The apparatus is indicated generally in FIG. 1 by the reference numeral 10, and a typical closure according to this invention is shown in several of the figures and referred to by the reference numeral 12.

According to one embodiment of the invention, an apparatus is provided which includes a conveyor 14 for feeding a plurality of bags, seriatim, past a plurality of work stations. Each bag may be such as those shown in FIGS. 2, 3, 4 and 9, and comprises a front panel 16, a rear panel 18, and side panels 20. Each of the front, rear and side panels is pliable, so that they may be folded in order to close and seal the bag.

Thus, for example, referring to FIGS. 1 and 2, a bag 22 is shown at a first work station in FIG. 1, and schematically represents a bag such as any bag 15, having the product intended to be packaged in that bag already placed therewithin. A bag 24 is shown at a second work station in FIG. 1, and it will be noted that its height is slightly less than that of bag 22. A first fold has been taken in bag 24, whereby the top portions of each of the end panels 20 have been creased so as to begin to form the indent 26 at each side of the bag.

In bag 28 shown in FIG. 1, the front and rear panels 16 and 18 have been brought into contiguous relationship one with the other so as to form shoulders 30 and 32 and so as to complete the indent 26 at each side of the bag. Creases 34 are thereby formed at the upper ends of each of the shoulder panels. In similar manner, folds 36 and 38 are formed in bags 40 and 42 in FIG. 1, so that bag 42 has the appearance of the bag shown in FIG. 2.

Thus, bag 44 as illustrated in FIG. 1 is also shown in FIG. 2, and is such that its mouth is shut and the top end of the bag — fold 38 — is upwardly facing with the front and back panels 16 and 18 being substantially contiguous at the top end of the bag.

Referring now to the closure 12, it will be noted that it has a pair of hook-like pre-formed open jaws 46 and 48 into which the top of the bag — fold 38 — may be inserted. The closure 12 also comprises a main panel portion 50.

Leaving aside, for the moment, the manner in which the closure 12 may be formed, it is noted that it is applied to the bag 44 by an applicator head 52, as shown in FIG. 1. Thereafter, the bag with a closure applied thereto is delivered past an adhesive applicator head 54, where adhesive 56 is applied to at least a portion of the closure 12; as shown with respect to bags 58 in FIGS. 1 and 3.

A folding head 60 next folds the upper portion of the bag between folds 36 and 38 forwards at the crease 34, as shown with respect to bags 62 in FIGS. 1 and 4, so that the adhesive 56 on the main panel portion 50 of the closure 12 contacts the front panel 16 of the bag 62 on the shoulder portion thereof above the shoulder crease 30. Thereafter, as shown in FIG. 1 at bags 64 and 66, a pressure strip 68 is placed so that the bags may be fed beneath it and pressure attained against the closures 12 so that the adhesive bond between each closure 12 and each front panel 16 of the respective bag to which each closure is applied may be at least partially set up.

When the adhesive 56 is a hot melt adhesive, the pressure bar 68 may also comprise a cooling panel to assist in setting up the adhesive bond to secure the closure 12 to each respective bag 15.

It should also be noted that the present discussion is with respect to a closure 12 having two hook-like open jaws 46 and 48. It is obvious, however, that a closure having a single hook-like jaw may be applied to any bag 15, or one having more than two hook-like jaws depending on the size of the bag and the nature of the product contained therewithin.

Figure 9:
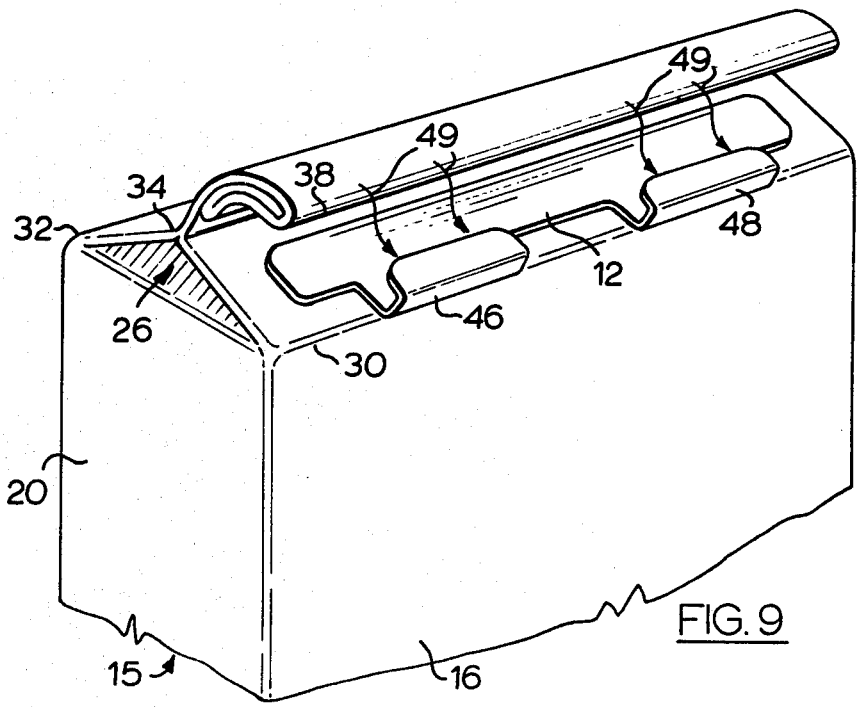
FIG. 9 is a view similar to FIGS. 2, 3 and 4 showing a bag with a closure attached thereto being re-closed.

FIG. 9 shows a bag 15 having a closure 12 applied thereto, where the bag has been opened and is being re-closed. The procedure of re-closing the bag 15 is simply the insertion of the fold 38 into jaws 46 and 48, as shown by arrows 49. It is obvious that the bag 15 is re-closable many times at the will of the consumer, for purposes of removing product from the bag at any time; and that each time the bag may be substantially re-sealed and shut by inserting the fold 38 at the top end of the bag into jaws 46 and 48 of closure 12. Such would not be the case, however, unless the closure 12 is securely applied to the shoulder portion of the front panel 16 of shoulder crease 30 by apparatus as discussed above.

Referring to FIGS. 5 to 8, and once again to FIG. 1, it will be noted that each closure 12 may be formed from a strip or roll of suitable thermoplastic material such as ABS or sheet styrene, and applied in accordance with this invention. Thus, a roll of material 70 is shown in FIG. 1, and feeds from a spindle 72 to a forming station 74, and thereafter to a cooling station 76 and thence to the applicator head 52. It should also be noted that each closure 12 may be such that the portion which is removed from the closure between jaws 46 and 48 is the same size as either of the jaws 46 and 48 when flat; in other words, a strip of sufficient width such as strip 78 shown in FIG. 5 can be provided, from which two rows of closures **12*a* and 12*b*** may be formed.

Figure 7:
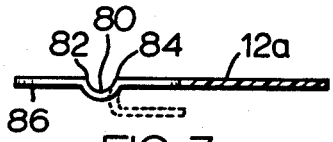
FIG. 7 is a cross-sectional view looking in the direction of arrow 7—7 in FIG. 6.
Figure 8:
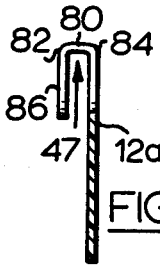
FIG. 8 is a view similar to FIG. 7 showing a closure after yet another operation.

Each closure 12 is formed by causing a wide crease having well defined edges to be formed along each tab from which jaws 46 and 48 will be formed, where the width of the crease is sufficient that when the jaws are formed the fold 38 of a bag 15 may be accommodated by the jaws 46 and 48. Thus, a crease 80 is formed along a central portion of the strip 78 shown in FIG. 5 — or, in any event, across each of the tabs which will be formed into jaws. The crease 80 has edges 82 and 84 as shown in FIGS. 7 and 8; and when the forward tip 86 is folded as shown, the jaw opening 47 becomes apparent.

Figure 5:
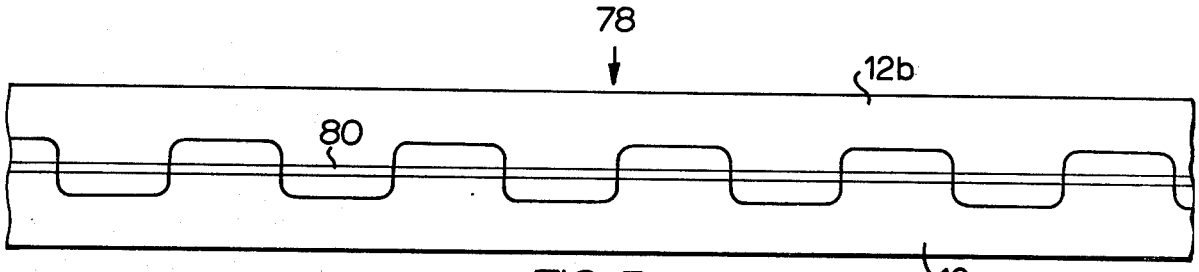
FIG. 5 is a view looking downwards at closures being formed at work stations therefor in the apparatus of the present invention, as indicated generally at arrow 5 in FIG. 1.
Figure 6:
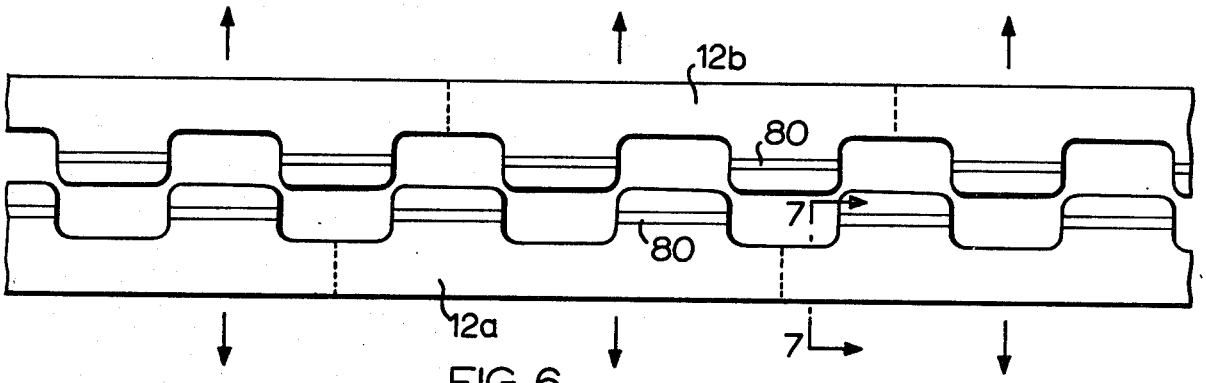
FIG. 6 is a view similar to FIG. 5 but showing the subsequent step.

FIG. 6 shows a further step from FIG. 5, where the strips for closures **12*a* and 12*b* are separated, with those for closures 12*b* to be utilized at another time or, more likely, in another apparatus which is back-to-back with the apparatus of FIG. 1. As noted, each closure 12 or 12*a* may be formed at appropriate stations of apparatus according to the present invention. Thus, formation of the crease 80, separating of strips 12*a* and 12*b* if necessary, and folding of the tip 86 so as to form jaw opening 47, may all take place in forming apparatus indicated generally at 74, after which each closure is passed through cooling station 76. Thereafter, the individual closures 12 are separated and applied to their respective bags 15 at applicator head 52**.

Suitable material from which the closures 12 may be formed is thermoplastic material such as ABS or styrene. Sheet styrene material having a thickness of 0.005 to 0.015 inches may be quite suitable; and is sufficiently rigid so that when the jaws 46 and 48 are formed, they serve to hold the fold 38 of a bag 15 in place; thereby assuring that the bag remains closed and substantially sealed.

There has been taught an apparatus for applying closures to bags and the like, where attachment of the closure to the bag is assured in order that the bag may be opened and re-closed at will by the consumer. A method for applying closures to bags has also been taught. The closures are applied to the bags after the product which is intended to be packaged and sold therein has been placed in the bag, and no additional working or handling of the bag except by machinery operating against the pliable top ends of the front, rear and side panels of the bag are necessary. Obviously, nearly any size of bag may be accommodated, with an appropriate closure therefor. Also, hot or cold melt adhesives may be used, with appropriate pressure and/or cooling stations to assure that the adhesive sets up, without damage to the contents within the bag.

Alterations, amendments or other embodiments of the invention will be obvious, without departing from the spirit and scope of the appended claims.

The embodiments of the invention in which an exclusive property or privilege is claimed are defined as follows:

1. The method of applying formed closures to bags and like containers; where each such bag has a bottom, a shuttable and reclosable mouth at its top, side panels and front and back panels, at least said side and front and back panels being pliable; where each bag has at least one fold in said front and back panels at the top thereof; and where each formed closure comprises a main panel portion that is applied to said front panel of a bag and at least one tab portion which presents a hook-like pre-formed open jaw into which the top of the bag, when shut is inserted; comprising the steps of:

(a) feeding a plurality of bags, seriatim, past at least one station for folding together the top ends of said front, back and side panels thereof, towards a second closure-applying station in a position downstream of said at least one station with respect to the direction of feeding of said plurality of bags;

(b) simultaneously feeding a strip of thermoplastic material in a path which leads to said second closure-applying station; and at positions upstream of said second closure-applying station with respect to the direction of feeding of said strip thermoplastic material performing the steps of:

(i) forming a longitudinal crease in at least a portion of said strip material;

(ii) folding said portion at said crease to form a jaw opening;

(iii) cutting individual formed closures, seriatim, from said formed strip material and feeding said individual formed closures one at a time to said second closure-applying station; and thereafter performing the steps of:

(c) applying the at least one open jaw of said formed closure over the folded top end of a bag;

(d) applying adhesive to the surface of the main panel portion of said formed closure which faces said front panel of the bag on which said formed closure has been placed; and (e) folding the top end of said bag with said formed closure towards said front panel of said bag, and temporarily applying pressure against said formed closure and bag.

2. The method of claim 1 where said strip of thermoplastic material is sufficiently wide to have two closures formed therefrom across its width and the second so-formed closure is fed at a different time than the first so-formed closure to said second closure-applying station.

3. The method of claim 1 where step (a) includes forming at least two folds, one after another, in said folded together top ends.

4. The method of claim 1 where step (b) includes the further steps of:

(iv) prior to step (i), heating at least the upstream portion of said strip material; and (v) after step (iii), cooling the upstream portion of said strip material.

* * * * *